US012110153B1

(12) United States Patent
Robertson

(10) Patent No.: US 12,110,153 B1
(45) Date of Patent: Oct. 8, 2024

(54) CONTAINER WITH CHANGEABLE DECORATIVE INSERT CAPABILITY

(71) Applicant: Covering the Bases, Inc., Westport, CT (US)

(72) Inventor: Krista Robertson, Westport, CT (US)

(73) Assignee: Covering the Bases, Inc., Westport, CT (US)

( * ) Notice: Subject to any disclaimer, the term of this patent is extended or adjusted under 35 U.S.C. 154(b) by 0 days.

(21) Appl. No.: 18/582,201

(22) Filed: Feb. 20, 2024

Related U.S. Application Data

(63) Continuation of application No. 18/432,649, filed on Feb. 5, 2024.

(60) Provisional application No. 63/490,587, filed on Mar. 16, 2023.

(51) Int. Cl.
*B65D 85/00* (2006.01)
*B65D 25/20* (2006.01)
*B65D 25/30* (2006.01)

(52) U.S. Cl.
CPC ..... *B65D 25/205* (2013.01); *B65D 25/30* (2013.01); *B65D 2203/00* (2013.01)

(58) Field of Classification Search
CPC .. B65D 21/0209; B65D 25/30; B65D 25/205; B65D 2203/00
USPC ..... 206/459.5, 745, 818; 220/4.26, 4.27, 220/4.33, 4.34, 23.83
See application file for complete search history.

(56) References Cited

U.S. PATENT DOCUMENTS 4,878,579 A * 11/1989 Hager ..... G09F 1/12 206/0.83
4,890,739 A * 1/1990 Mize, Jr. ..... B65B 61/20 206/524.8
4,915,214 A * 4/1990 Wieder ..... A47G 1/12 206/0.82
5,755,323 A * 5/1998 Zahn ..... B65D 85/58 206/459.5
6,814,227 B2 * 11/2004 Seligman ..... A47G 1/12 206/8
6,831,541 B1 * 12/2004 Seidler ..... H01F 7/0263 206/818
7,055,216 B2 * 6/2006 Seidler ..... A45D 40/24 16/320
2008/0149518 A1 * 6/2008 Macor ..... B65D 85/58 206/459.5

* cited by examiner

*Primary Examiner* — Luan K Bui
(74) *Attorney, Agent, or Firm* — Neal, Gerber & Eisenberg LLP

(57) ABSTRACT

A container is provided comprising a storage compartment with a display surface and one or more first sidewalls extending up from the display surface and defining an open top opposite the display surface, an insert compartment comprising a base and one or more second sidewalls extending up from the base and defining an opening opposite the base, and at least one attachment mechanism configured to detachably couple the insert compartment to the display surface of the storage compartment, wherein a height of the one or more second sidewalls is configured to house a decorative insert within the insert compartment, and the display surface is made of a substantially clear material configured to visibly display the decorative insert through the display surface.

20 Claims, 16 Drawing Sheets

600

600

600

CONTAINER WITH CHANGEABLE DECORATIVE INSERT CAPABILITY

PRIORITY

This application is a continuation of U.S. patent application Ser. No. 18/432,649, filed on Feb. 5, 2024, which claims priority to U.S. Provisional Patent Application No. 63/490,587 filed on Mar. 16, 2023, the contents of each of which are incorporated herein in its entirety.

TECHNICAL FIELD

The present invention relates to trays and other types of containers and more specifically, to containers configured to interchangeably display decorative inserts.

BACKGROUND

Needlepoint art and other canvas artwork may be displayed in various ways, for example, as standalone finished pieces, as an addition to another object (e.g., a stocking, cushion, coaster, etc.), or in picture frames and the like. Other popular options include trays, boxes, or other containers with built-in display areas for storing and displaying needlepoint art or other decorative inserts. Some existing trays are made mostly or entirely of a clear acrylic material to better showcase the needlepoint art, while others are made mostly of wood or other opaque material but have transparent viewing area for displaying the needlepoint art. The built-in display area may include a slot or opening for receiving the artwork to be displayed, and also removing and/or replacing the artwork, as desired. Some existing trays have slots that are open on both ends to facilitate insertion and removal of the artwork. However, such trays are not ideal because the inserted artwork tends to slide out of the slot too easily from either end, especially while handling or using the tray. Also, the open slots leave the needlepoint art exposed, at least on those two sides, and thus, susceptible to damage due to, for example, accidental spills, water seepage, environmental contaminants, and more.

Thus, there is still a need for a container that is configured to interchangeably display needlepoint art and other decorative inserts, while also fully protecting the inserts in a secure and convenient manner.

SUMMARY

Various improved containers configured to securely, protectively, and conveniently house changeable decorative inserts are provided herein. In one exemplary embodiment, a container comprises: a storage compartment comprising a display surface and one or more first sidewalls extending up from the display surface and defining an open top opposite the display surface; and an insert compartment comprising a base and one or more second sidewalls extending up from the base and defining an opening opposite the base; and at least one attachment mechanism configured to detachably couple the insert compartment to the display surface of the storage compartment, wherein a height of the one or more second sidewalls is configured to house a decorative insert within the insert compartment, and the display surface is made of a substantially clear material configured to visibly display the decorative insert through the display surface.

In another exemplary embodiment, a container comprises: an insert compartment comprising a display surface, one or more first sidewalls extending down from the display surface and defining an open bottom opposite the display surface, a bottom panel, and at least one attachment mechanism configured to detachably couple the bottom panel to the one or more first sidewalls opposite the display surface, wherein a height of the one or more first sidewalls is configured to house a decorative insert within the insert compartment, and the display surface is made of a substantially clear material configured to visibly display the decorative insert through the display surface; and a storage compartment comprising a base and one or more second sidewalls extending up from the base and defining an open top opposite the base, wherein the bottom panel of the insert compartment is configured to be removably coupled to the open top of the storage compartment. According to various aspects, the open bottom of the insert compartment is configured to receive the decorative insert with a decorative side of the insert facing upwards towards the display surface. According to some aspects, a height of one or more second sidewalls is at least twice the height of the one or more first sidewalls.

In another exemplary embodiment, a container comprises: a storage compartment comprising a base and a plurality of first sidewalls extending vertically from the base and defining an open top opposite the base, the first sidewalls comprising a front wall; an insert compartment comprising a display surface and a plurality of second sidewalls extending horizontally from the display surface and defining an opening opposite the display surface; and at least one attachment mechanism configured to detachably couple the plurality of second sidewalls to the front wall of the storage compartment, so that the opening is covered by the front wall, wherein each of the second sidewalls has a length configured to house a decorative insert within the insert compartment, and the display surface is made of a substantially clear material configured to visibly display the decorative insert through the display surface. According to aspects, the length of each of the second sidewalls is configured to position the display surface a preset distance from the front wall of the storage compartment, the preset distance being determined based on a thickness of the decorative insert. According to various aspects, the opening of the insert compartment is configured to receive the decorative insert with a decorative side of the insert facing parallel to the display surface and away from the front wall of the storage compartment. According to some aspects, the storage compartment is configured to form a cube.

While certain features and embodiments are referenced above, these and other features and embodiments of the present invention will be, or will become, apparent to one having ordinary skill in the art upon examination of the following figures and detailed description. It is intended that all such additional embodiments and features included within this description, be within the scope of the present invention, and be protected by the accompanying claims.

BRIEF DESCRIPTION OF THE DRAWINGS

The present invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
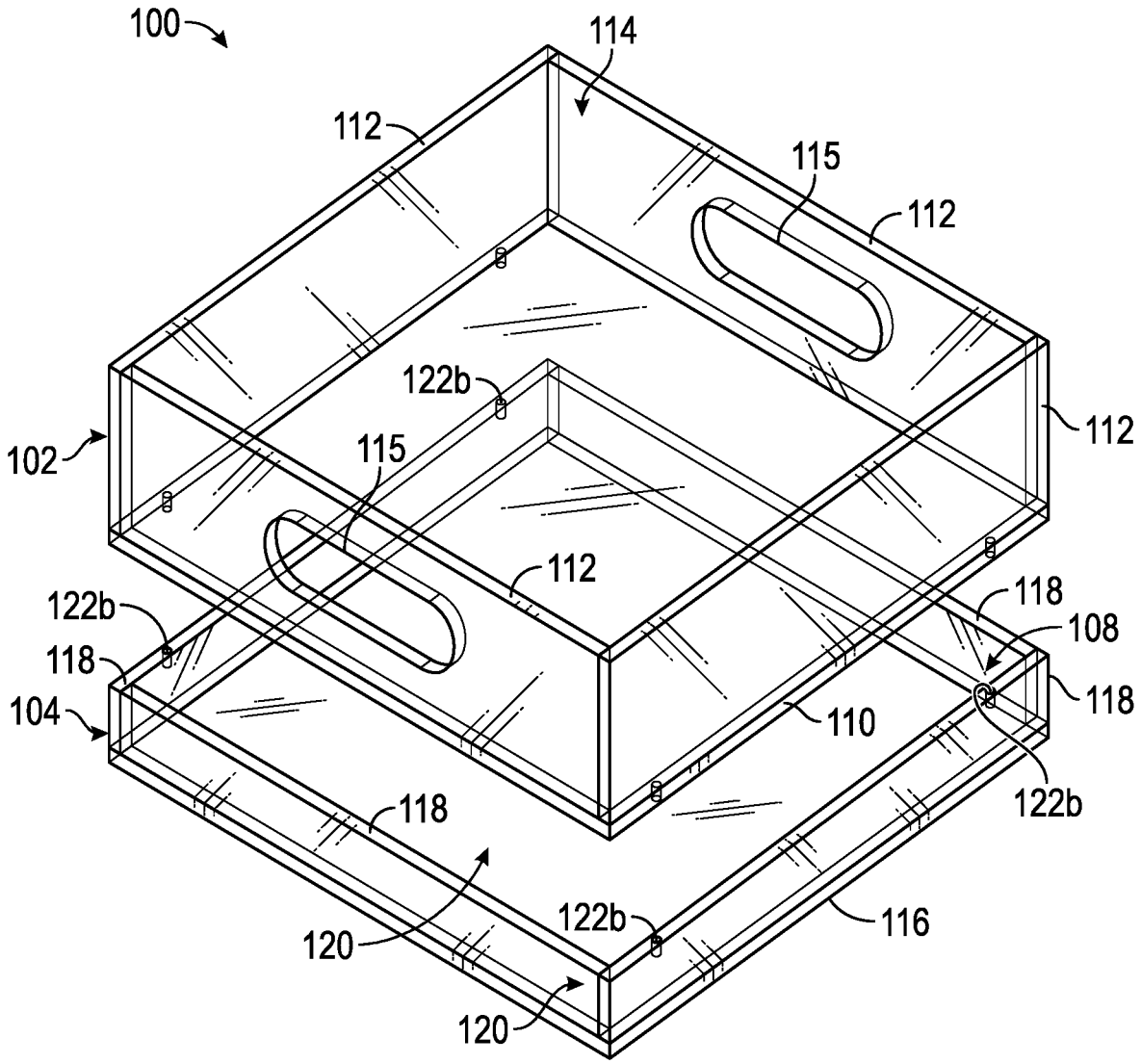
FIG. 1 is a front perspective view of an exemplary square-shaped tray with handles, in accordance with embodiments.

The description that follows describes, illustrates and exemplifies one or more particular embodiments of the present invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers or serial numbers in cases where such labeling facilitates a clearer description. Additionally, the drawings set forth herein are not necessarily drawn to scale, and in some instances proportions may have been exaggerated to more clearly depict certain features. Also, some of the drawings include partial views that have select parts removed for the sake of clarity with respect to the depicted portions. As stated above, this specification is intended to be taken as a whole and interpreted in accordance with the principles of the invention as taught herein and understood by one of ordinary skill in the art.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects.

Various containers configured to interchangeably display decorative inserts such as needlepoint art are described herein. The containers comprise an insert compartment configured to house and display the decorative insert. The insert compartment is coupled to a main body (or storage compartment) of the container using a secure and removable attachment mechanism that allows for replacement of the decorative insert, as needed. The insert compartment is also configured such that the container can have any shape or size, including oblong shapes, irregular shapes, and custom-designed shapes. The techniques described herein also enable the container to be configured as not only a tray or dish, but also a box, crate, or any other type of containment unit. Accordingly, while this disclosure provides specific examples of the types of containers and their shapes and sizes, it should be appreciated that this disclosure is not limited to only those examples and that containers with other shapes and sizes and/or types of containment units may be implemented using the techniques described herein.

FIGS. 1 and 2A to 2C illustrate an exemplary container 100 with changeable decorative insert capability, in accordance with embodiments. The container 100 comprises a main storage compartment 102 and an insert compartment 104 detachably coupled to the main compartment 102. The insert compartment 104 can be configured to house a decorative insert 106 within an open space 108 of the insert compartment 104. The decorative insert 106 may be needlepoint art, other canvas or thread-based art, or any other form of artwork that can fit within the open space 108. As shown, the insert compartment 104 is configured to be coupled underneath the storage compartment 102 such that a bottom surface 110 of the storage compartment 102 seals, or serves as a lid for, the insert compartment 104, thus securing the decorative insert 106 within the space 108 and protecting the insert 106 from damage.

The storage compartment 102 further comprises a plurality of first sidewalls 112 that extend up from the bottom surface 110 and define a top 114 of the storage compartment 102 opposite the bottom 110. The top 114 of the storage compartment 102 may be configured depending on an intended use of the container 100. For example, in some embodiments, the top 114 (also referred to herein as an "open top") is fully open so that the container 100 can be used as a tray (e.g., as shown in FIG. 1), dish, or shallow box. In other embodiments (not shown), the top 114 may be partially open and/or have a lid that is fully or partially moveable to allow access to an inside of the storage compartment 102.

Figure 3:
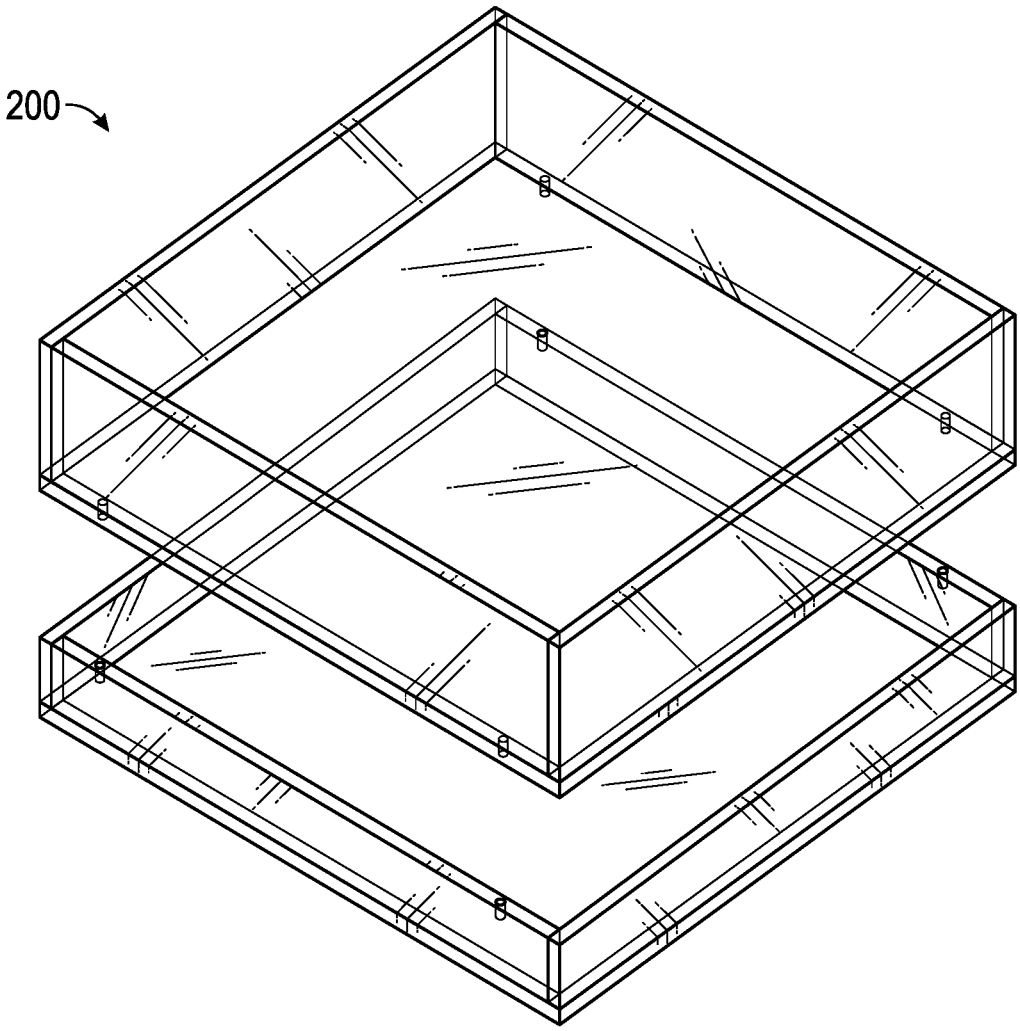
FIG. 3 is a front perspective view of another exemplary square-shaped tray but without handles, in accordance with embodiments.
Figure 4A:
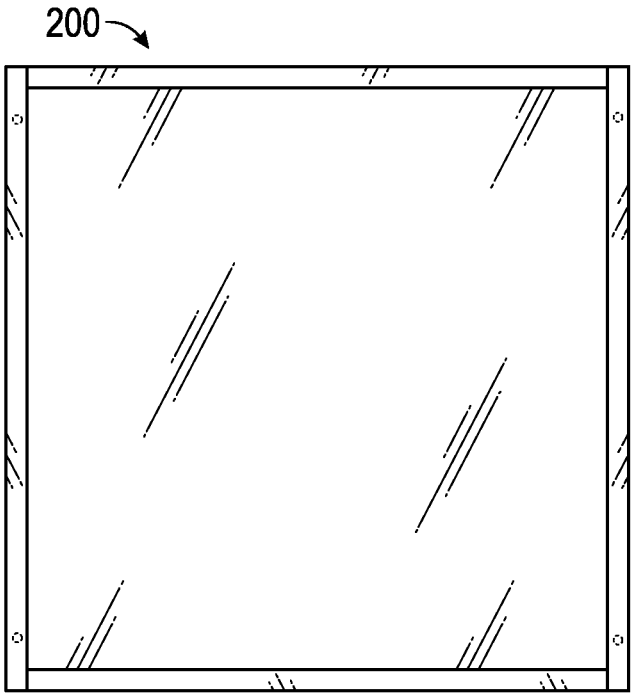
FIGS. 4A to 4C are top, side, and end views, respectively, of the square-shaped tray of FIG. 3, in accordance with embodiments.
Figure 4B:
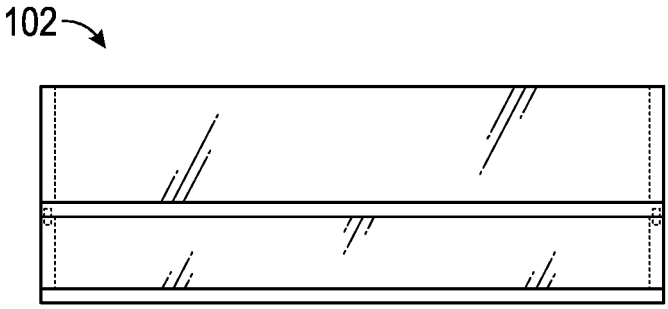
Figure 4C:
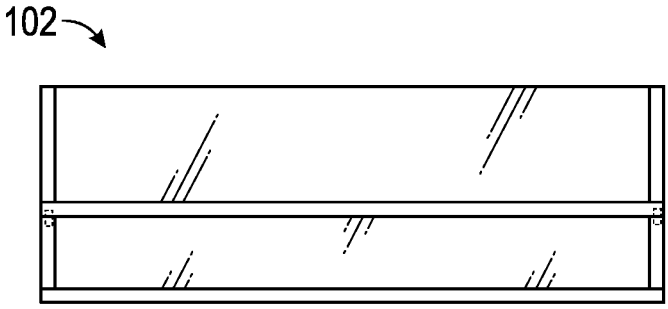

In various embodiments, at least one of the first sidewalls 112 comprises an aperture 115 configured to operate as a handle to facilitate use of the container 100. The handles 115 may be disposed on opposite ends or sidewalls 112 of the container 100, as shown, or on only one sidewall 112 (not shown). In other embodiments, the sidewalls may be solid walls, for example, as shown by container 200 in FIG. 3, which is substantially similar to the container 100 but for the lack of handles.

Figure 15:
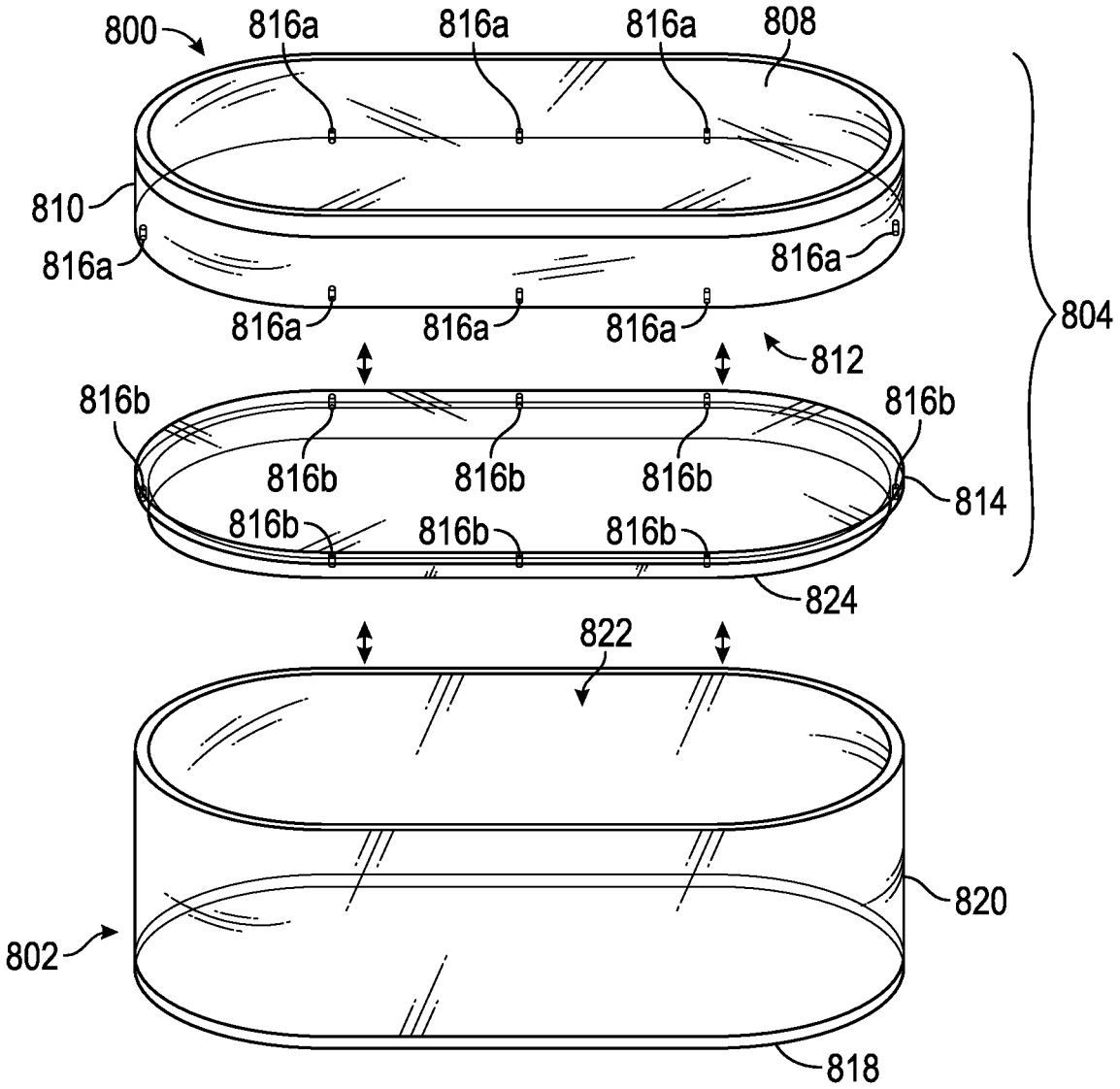
FIG. 15 is a front perspective view of an exemplary oval box, in accordance with embodiments.
Figure 16A:
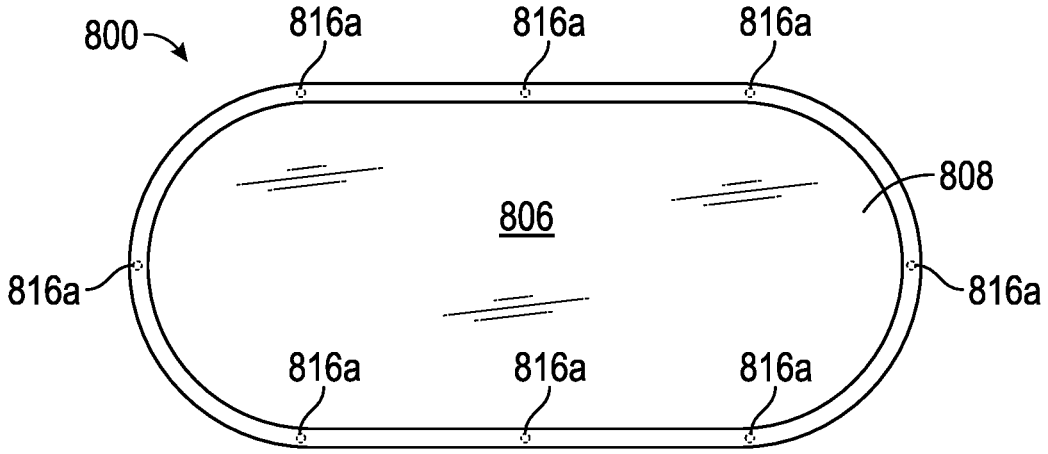
FIGS. 16A to 16C are top, side, and end views, respectively, of the oval box of FIG. 15, in accordance with embodiments.
Figure 16B:
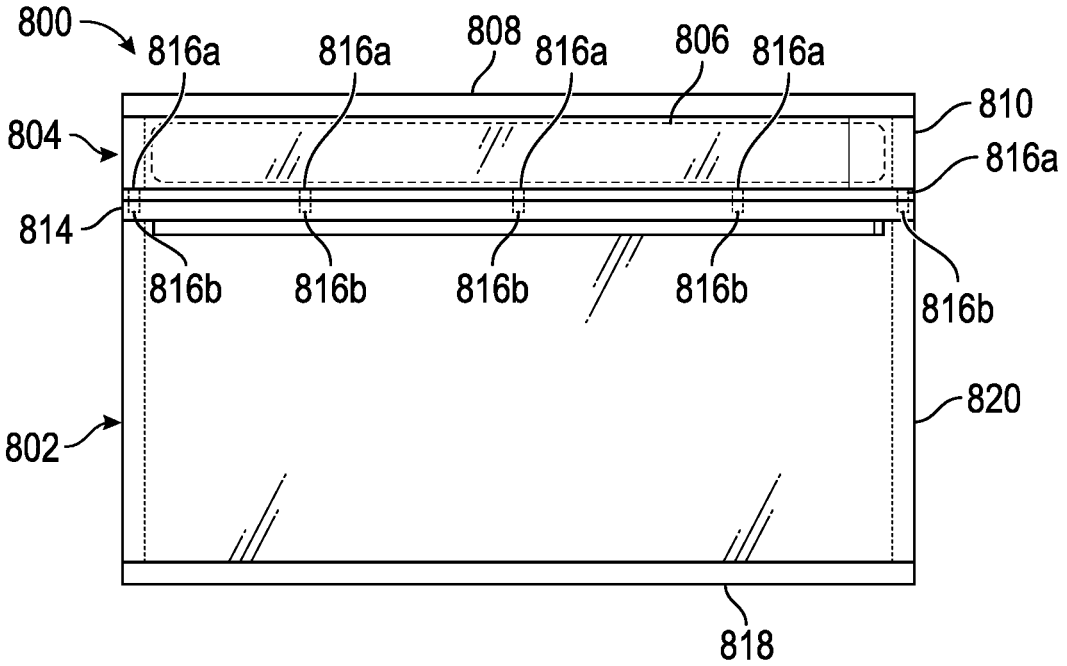
Figure 16C:
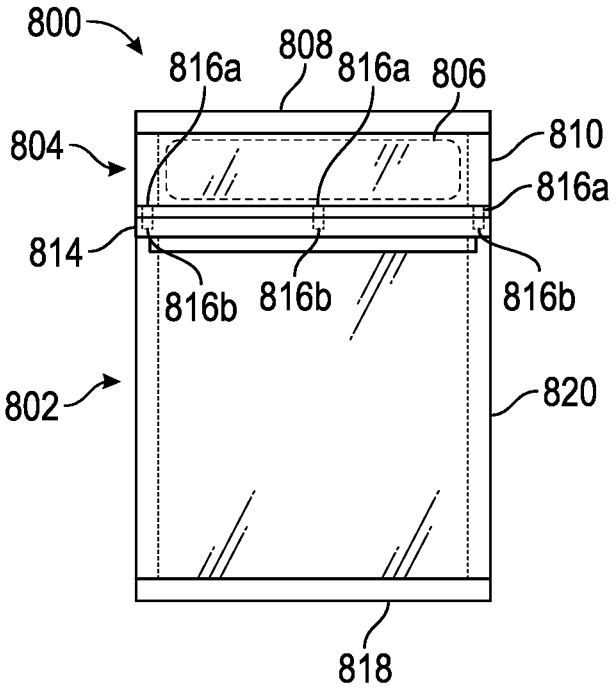
Figure 17:
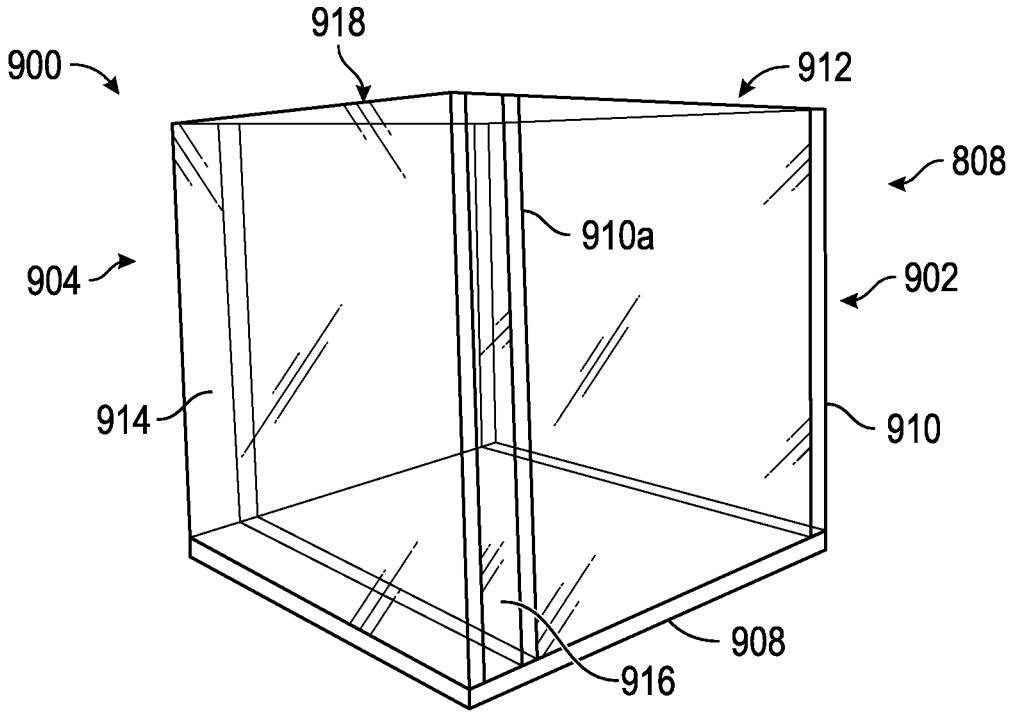
FIG. 17 is a front perspective view of an exemplary square box, in accordance with embodiments.

A height of the first sidewalls 112 can be configured to form a containment area in the storage compartment 102. In various embodiments, the height of the first sidewalls 112 (also referred to herein as "one or more first sidewalls") may also be configured based on an intended purpose or use for the storage compartment 102. For example, in the illustrated embodiment, the container 100 is configured as a tray and thus, the height of the first sidewalls 112 is relatively shallow (e.g., about 2 inches (in) or 51 millimeters (mm)). In other embodiments, the height of the first sidewalls 112 may been higher (e.g., about 3 in or 76 mm) or lower (e.g., about 1 in or 25 mm) depending on the type or style of tray. In still other embodiments, the height of the sidewalls may be configured to form other types of containers, such as a box or other high-walled container, for example, as shown in FIGS. 15 and 17.

Figure 2A:
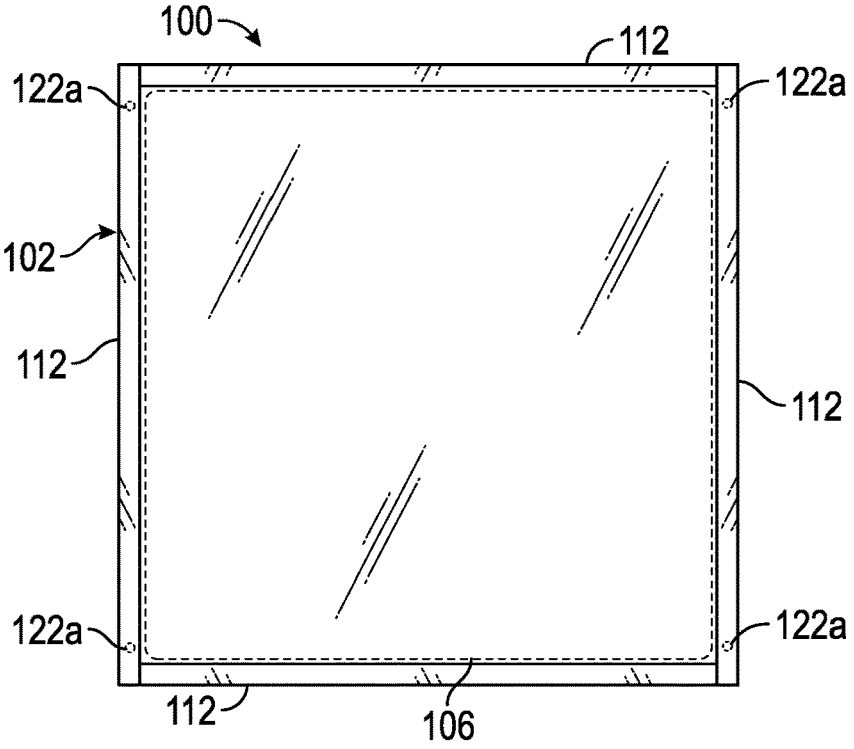
FIGS. 2A to 2C are top, side, and end views, respectively, of the square-shaped tray of FIG. 1, in accordance with embodiments.

The bottom surface 110 (also referred to herein as a "display surface") of the storage compartment 102 can be made of a substantially clear material configured to visibly display the decorative insert 106 through the bottom 110 of the storage compartment 102, as shown in FIG. 2A. In various embodiments, the plurality of first sidewalls 112 are also made of a substantially clear material, so that the decorative insert 106 is visible from any angle, or through any side 112 of, the storage compartment 102. In some embodiments, the insert compartment 104 is made of a substantially clear material as well, so that the decorative insert 106 is also visible from the sides of the insert compartment 104. In various embodiments, the storage compartment 102 and the insert compartment 104 are made of the same material. The substantially clear material may be a transparent acrylic material, other transparent plastic material, a clear glass material, or any other clear or transparent material. In one exemplary embodiment, the substantially clear material is a clear acrylic material that is about five millimeters (mm) thick.

As shown, the insert compartment 104 comprises a base 116 and a plurality of second sidewalls 118 that extend up from the base 116 and define an opening 120 opposite the base 116. The opening 120 is configured (e.g., sized and shaped) to receive the decorative insert 106 such that the decorative insert 106 can be placed flat within the open space 108 with a decorative side of the insert 106 facing upwards towards the storage compartment 102, or the bottom display surface 110 thereof. In addition, a height of the second sidewalls 118 (also referred to herein as "one or more second sidewalls") can be configured to enable the decorative insert 106 to be housed within the insert compartment 104.

Figure 2B:
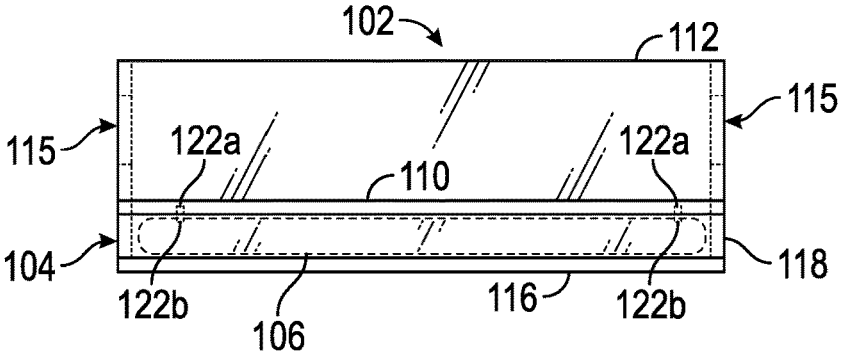
Figure 2C:
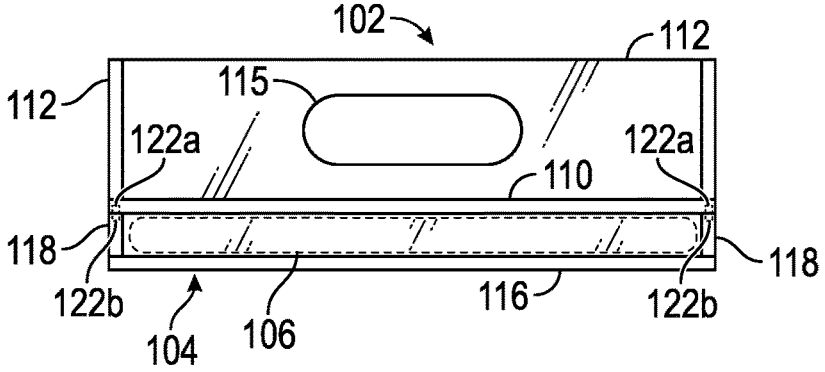

More specifically, the base 116 and the display surface 110 can be substantially flat surfaces that are disposed substantially parallel to each other upon coupling the insert compartment 104 to the storage compartment 102, as shown in FIGS. 2B and 2C. In embodiments, the height of the second sidewalls 118 can be configured to position the display surface 110 a preset distance from the base 116 when coupled together, wherein the preset distance is determined based on a thickness of the decorative insert 106. For example, the preset distance can be selected so that the insert 106 fits snugly within the space 108 without being compressed. In one exemplary embodiment, the second sidewalls 118 have a height of about 16 mm or 0.6 inch. In other embodiments, the height of the second sidewalls 118 may be higher to accommodate thicker inserts, such as, for example, needlepoint art with three-dimensional elements, beads, etc. In various embodiments, the height of the first sidewalls 112 is greater than the height of the second sidewalls 118, so that the containment area formed by the first sidewalls 112 is able to operate as a tray, dish, or other apparatus for storing item(s). In one exemplary embodiment, the first sidewalls 112 are at least twice the height of the second sidewalls 118.

As best seen in FIGS. 2A to 2C, the container 100 further comprises at least one attachment mechanism 122 configured to detachably couple the insert compartment 104 to the display surface 110 of the storage compartment 102. In various embodiments, the insert compartment 104 is magnetically attached to the storage compartment 102 with the decorative insert 106 disposed therebetween. In such cases, the at least one attachment mechanism 122 comprises a first plurality of magnets 122*a* disposed in the display surface 110 and a second plurality of magnets 122*b* correspondingly disposed in the one or more second sidewalls 118 or otherwise around the opening 120 of the insert compartment 104. For example, the first plurality of magnets 122*a* may be positioned at a first plurality of locations on the display surface 110, and the second plurality of magnets 122*b* may be positioned at a second plurality of locations on the one or more second sidewalls 118 that respectively align with the first plurality of locations when the insert compartment 104 is coupled to the storage compartment 102. In addition, the second plurality of magnets 122*b* may have an opposite polarity than the first plurality of magnets 122*a* in order to ensure magnetic attraction between, and thus coupling of, the first magnets 122*a* and the second magnets 122*b*.

In various embodiments, a thickness of the display surface 110 and/or the second sidewalls 118 may be configured to prevent breakage or otherwise withstand the forces that are applied to the clear material (e.g., acrylic) during attachment and detachment of the magnets 122. In one exemplary embodiment, an additional layer of clear material may be added under the display surface 110 to reinforce a bottom of the main compartment 102. In such cases, the first magnets 122*a* may be embedded in the reinforcement layer of the bottom surface 110. Similarly, an additional layer of clear material may be added to a top of each second sidewall 118 to reinforce the walls 118 of the insert compartment 104. And in such cases, the second magnets 122*b* may be embedded in the reinforcement layer of the second sidewalls 118.

Figure 12A:
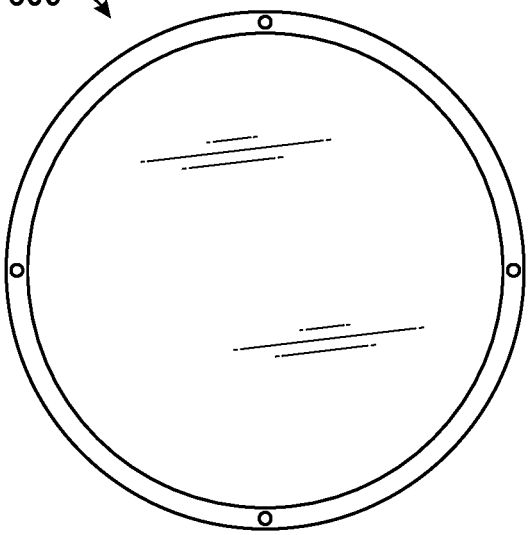
FIGS. 12A and 12B are top and side views, respectively, of the circular tray of FIG. 11, in accordance with embodiments.
Figure 12B:
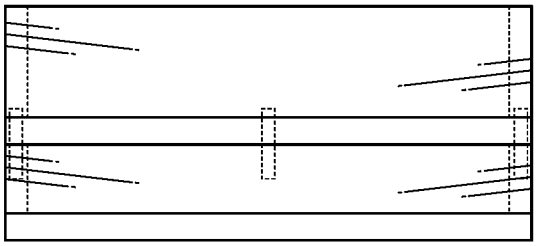

The total number of magnets 122 included in the container 100, the placement of the magnets 122 around the opening 120, and/or a strength of each magnet 122 may vary depending on a size, weight, and/or shape of the insert compartment 104 and/or the decorative insert 106. For example, in the illustrated embodiment, the storage compartment 102 includes four first magnets 122*a* disposed near the four corners of the display surface 110, and the insert compartment 104 includes four second magnets 122*b* disposed along the second sidewalls 118 near corresponding corners of the opening 120. In other embodiments, the magnets 122 may be arranged near the middles of the sidewalls 112 and 118, instead of near the corners, so as to form a diamond shape on each compartment 102, 104. This arrangement may also be selected for containers that have a rounded-shape or otherwise do not have corners, such as, for example, the circular container 600 shown in FIGS. 12A and 12B. In other embodiments, the container 100 may include additional magnets, for example, at the corners and the middles, to more securely attach the insert compartment 104 to the main compartment 102, for example, if the insert compartment 104 and/or the decorative insert 106 are made of a heavier material or are larger in size (and thus heavier), or to accommodate an oblong shape like the oval-shaped container 700 shown in FIG. 13, for example.

While the embodiments shown and described herein use magnets 122 to detachably couple the main compartment 102 to the storage compartment 14, other types of attachment mechanisms may be used in other embodiments, in addition to or instead of the magnets. For example, the at least one attachment mechanism 122 may include a removable adhesive, hook and loop or any other type of fastener, friction-fit mechanism, twist lock mechanism, or any other type of removable attachment mechanism.

As shown, the storage compartment 102 and the insert compartment 104 are configured to have substantially similar shapes, and the first sidewalls 112 and the second sidewalls 118 are configured to be substantially vertical walls, such that, upon coupling the insert compartment 104 to the bottom display surface 110 of the storage compartment 102, the second sidewalls 118 are flush with the first sidewalls 112. In other embodiments, only the display surface 110 of the storage compartment 102 and the top opening 120 of the insert compartment 104 may be similarly shaped, so that the top opening 120 can be sealed or enclosed by the display surface 110 after placing the decorative insert 106 within the open space 108 of the insert compartment 104. In such cases, the first sidewalls 112 may extend outwards or inwards and thus, may not be flush with the second sidewalls 118. For example, the first sidewalls 112 may flare out at an angle relative to the bottom surface 110, or may be curved, jagged, slanted, or have any other non-vertical form.

Figure 5:
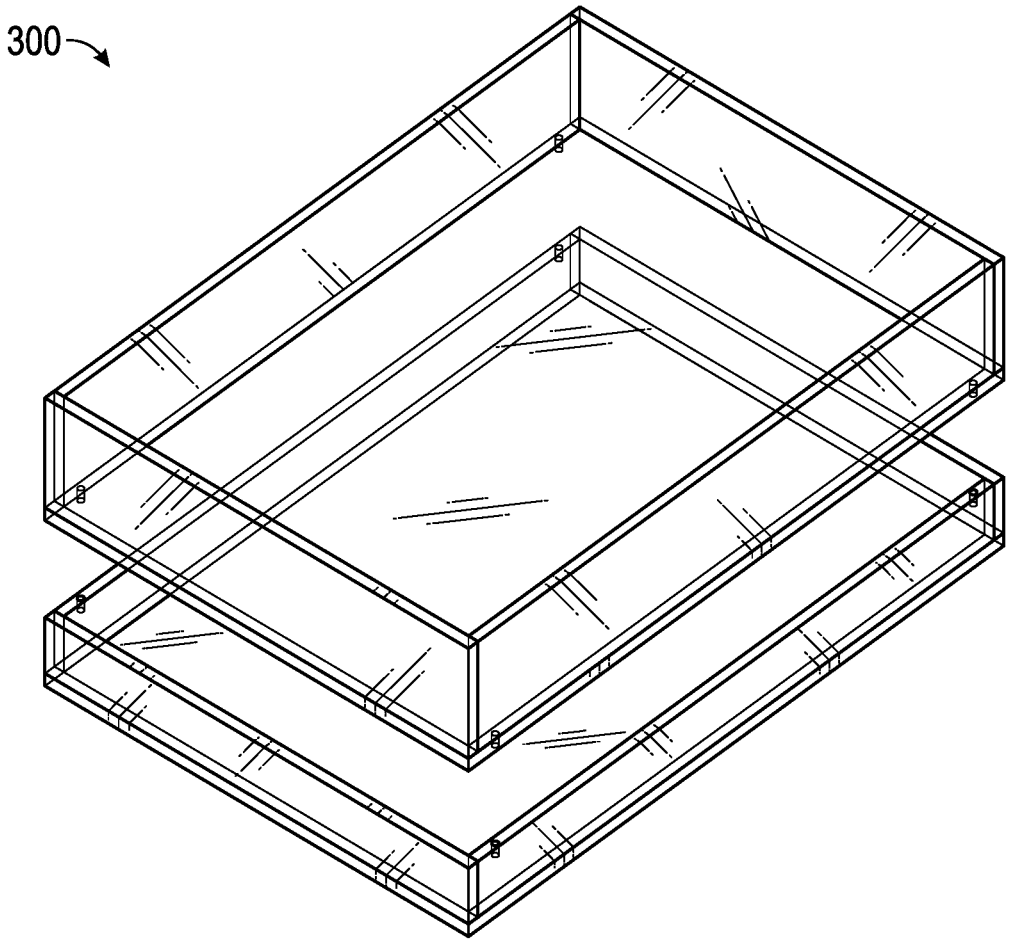
FIG. 5 is a front perspective view of an exemplary rectangular tray, in accordance with embodiments.
Figure 6:
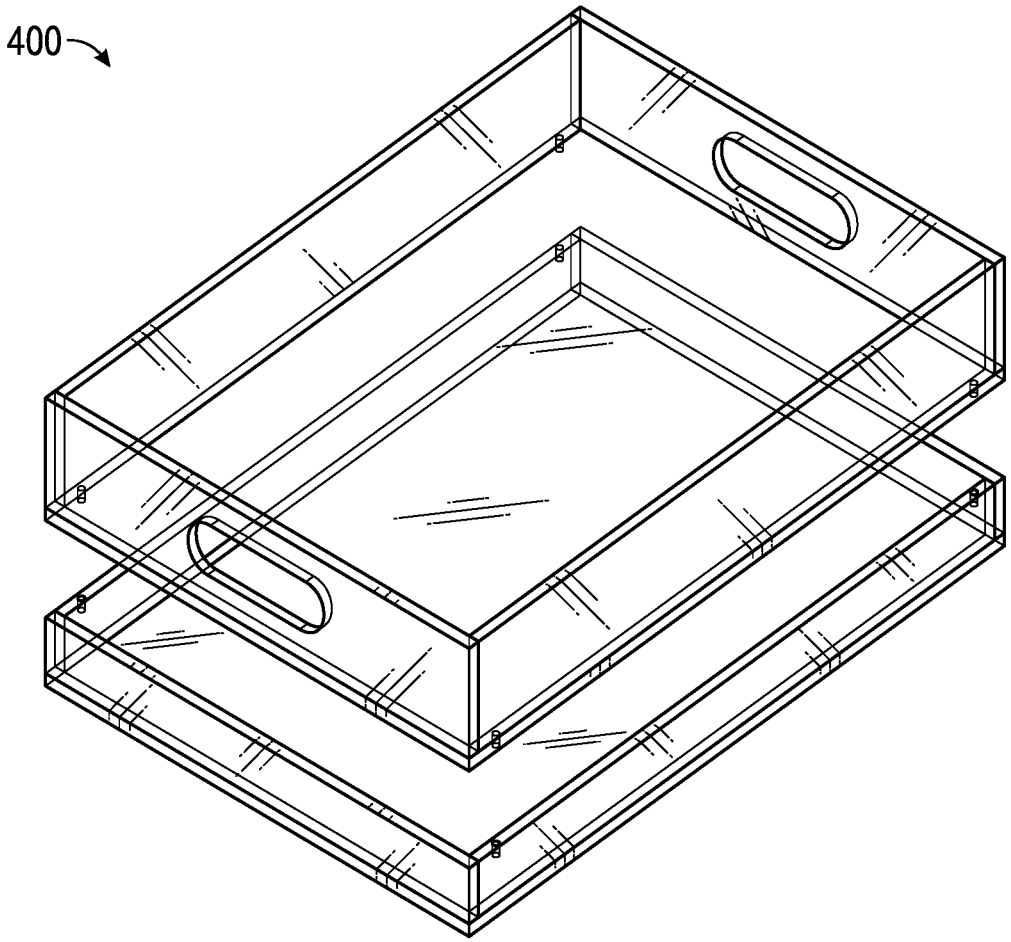
FIG. 6 is a front perspective view of another exemplary rectangular tray but with handles, in accordance with embodiments.
Figure 7A:
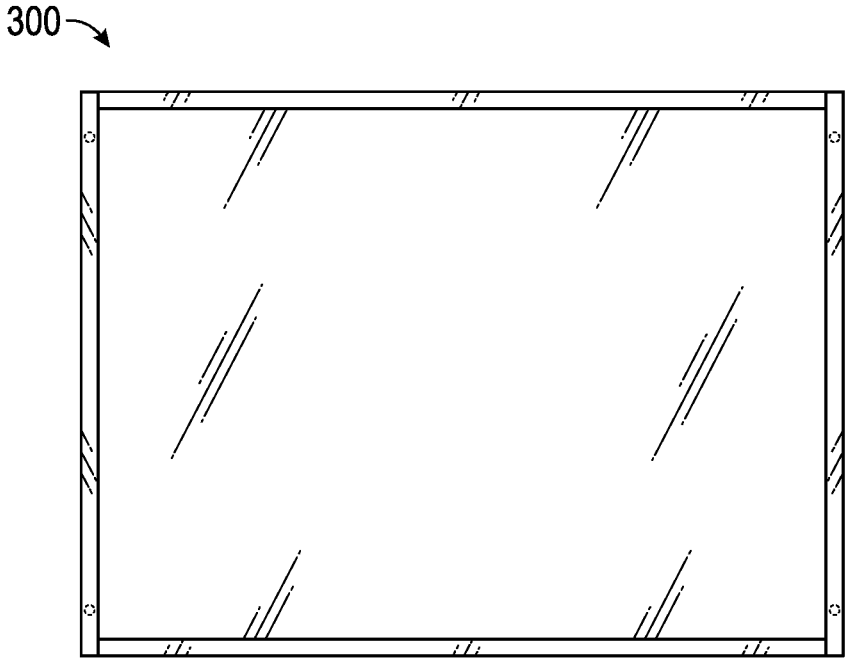
FIGS. 7A to 7C are top, side, and end views, respectively, of the rectangular tray of FIG. 5, in accordance with embodiments.
Figure 7B:
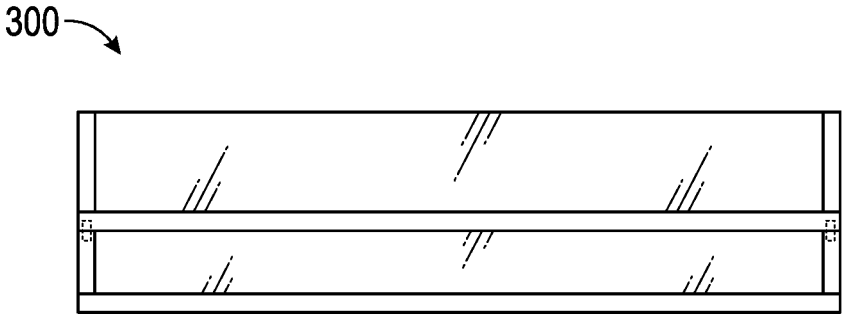
Figure 7C:
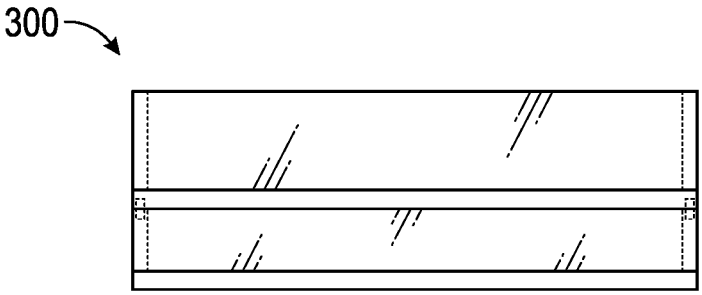
Figure 8A:
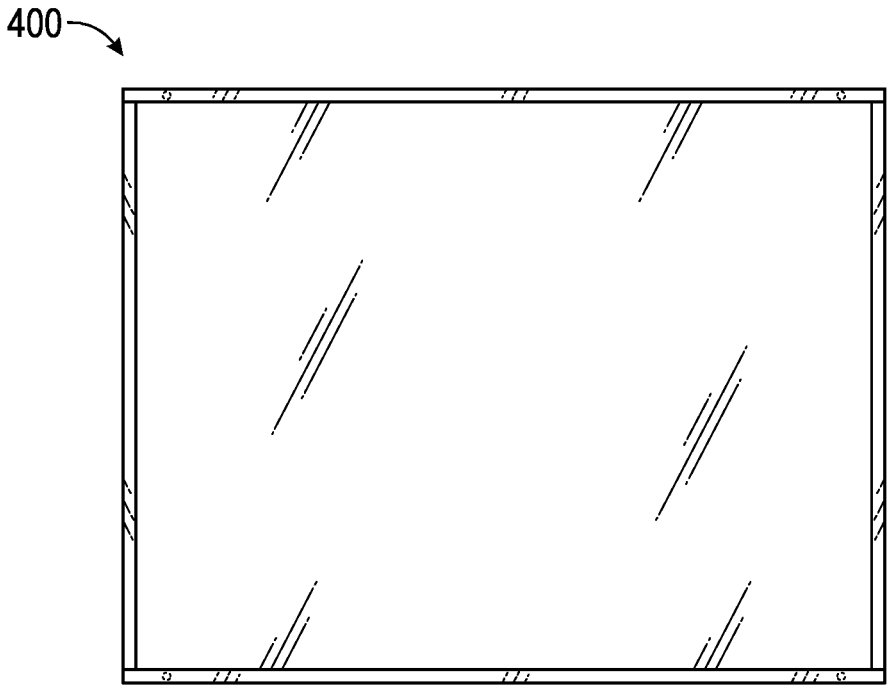
FIGS. 8A to 8C are top, side, and end views, respectively, of the rectangular tray of FIG. 6, in accordance with embodiments.
Figure 8B:
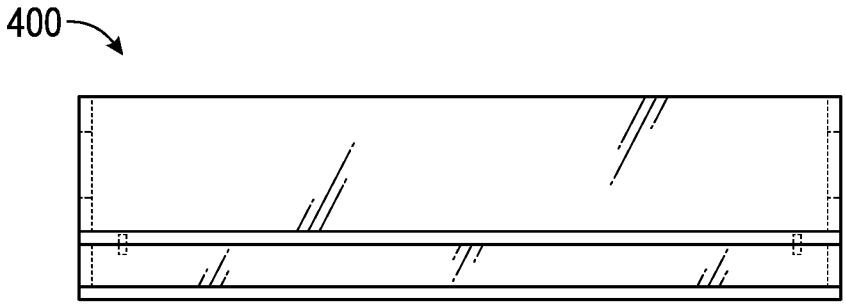
Figure 8C:
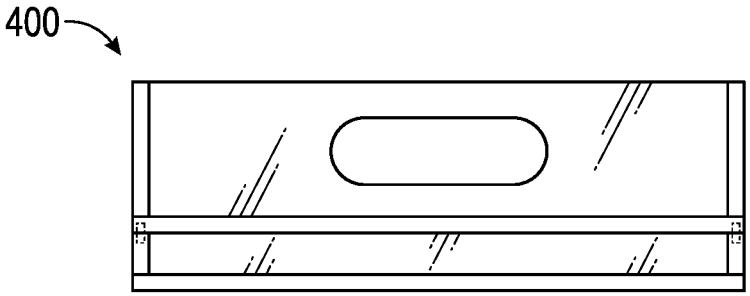
Figure 9:
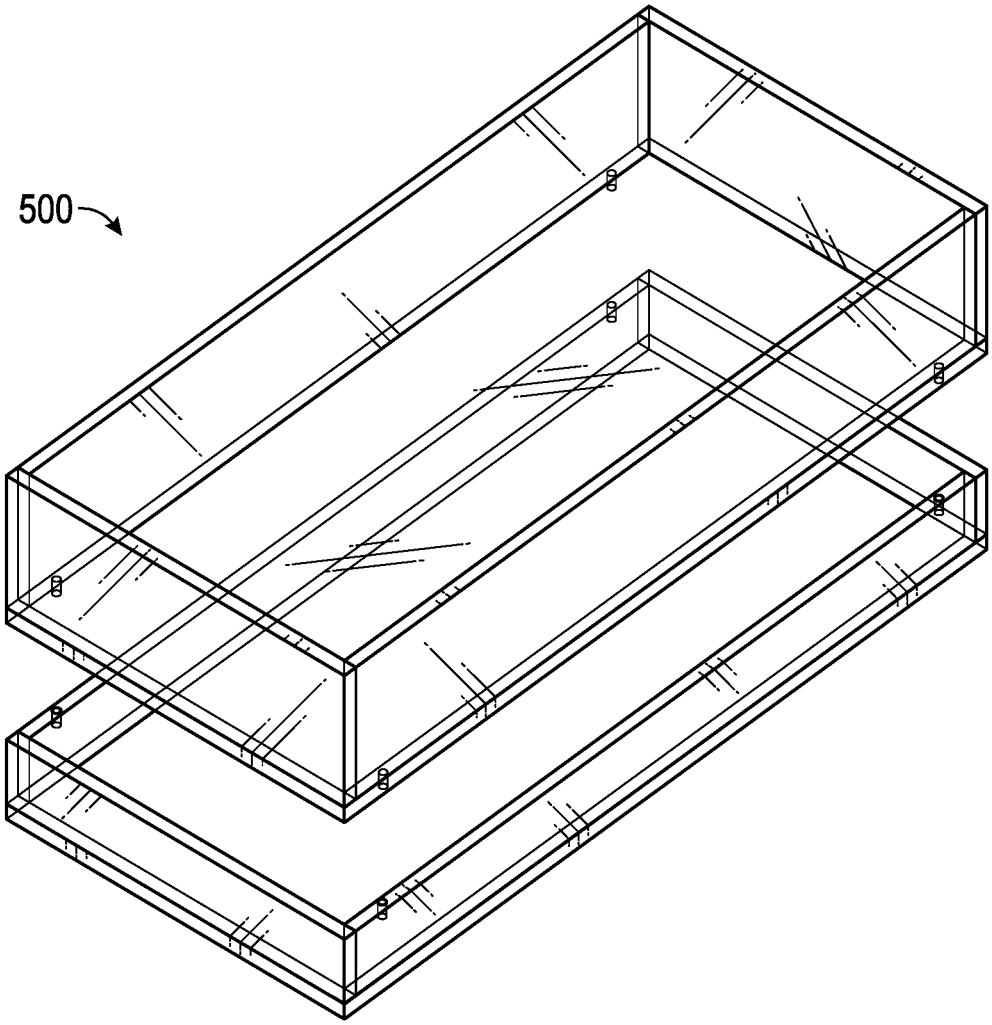
FIG. 9 is a front perspective view of another exemplary rectangular tray with longer sides, in accordance with embodiments.
Figure 10A:
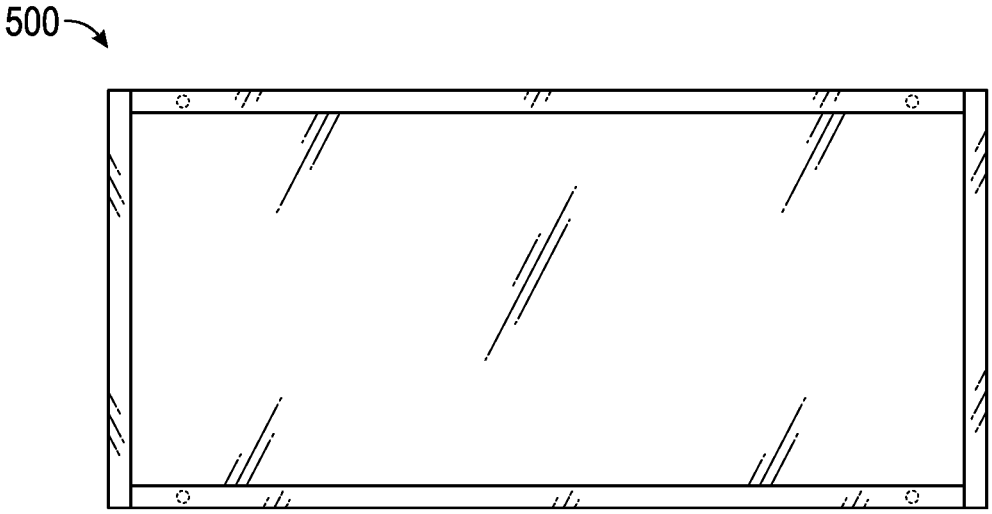
FIGS. 10A to 10C are top, side, and end views, respectively, of the rectangular tray of FIG. 9, in accordance with embodiments.
Figure 10B:
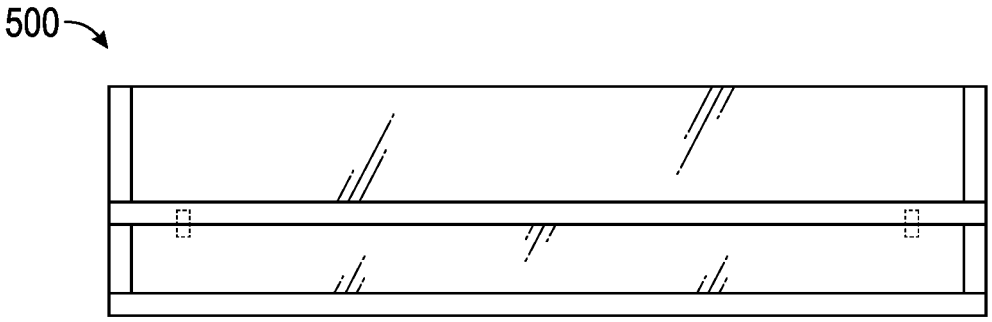
Figure 10C:
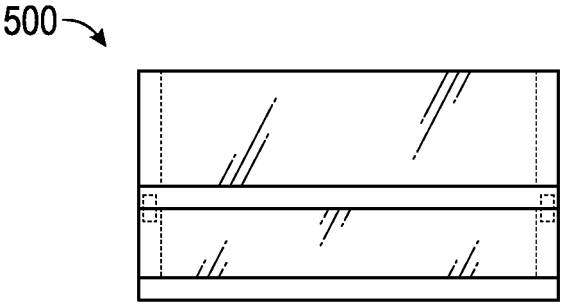
Figure 11:
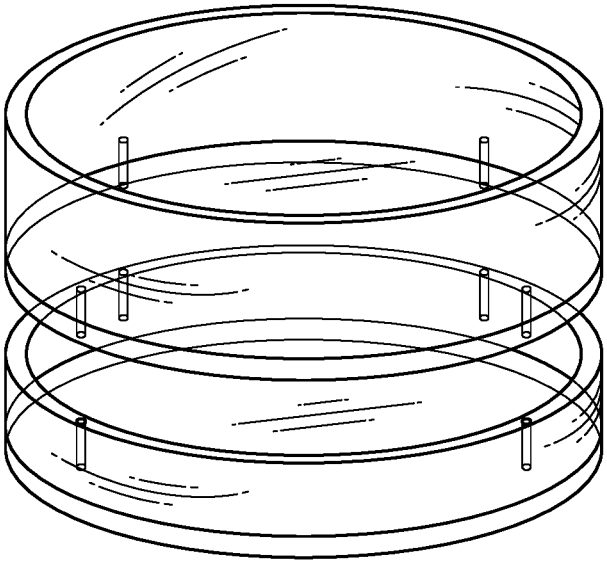
FIG. 11 is a front perspective view of an exemplary circular tray, in accordance with embodiments.
Figure 13:
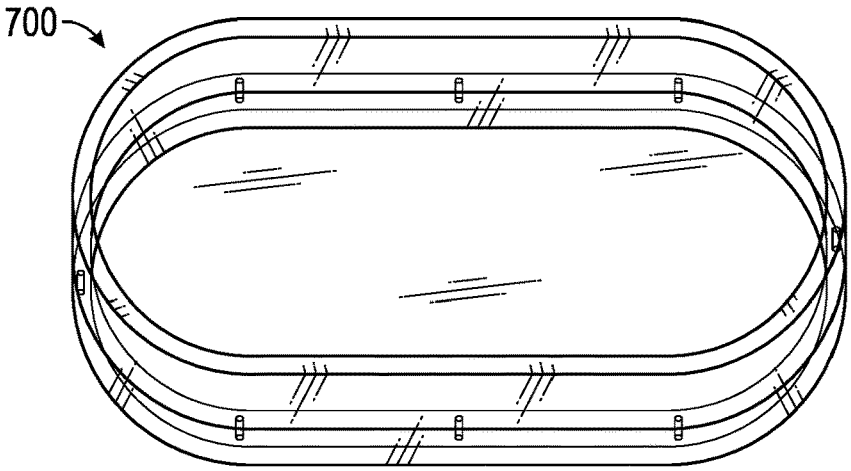
FIG. 13 is a front perspective view of an exemplary oval tray, in accordance with embodiments.
Figure 14A:
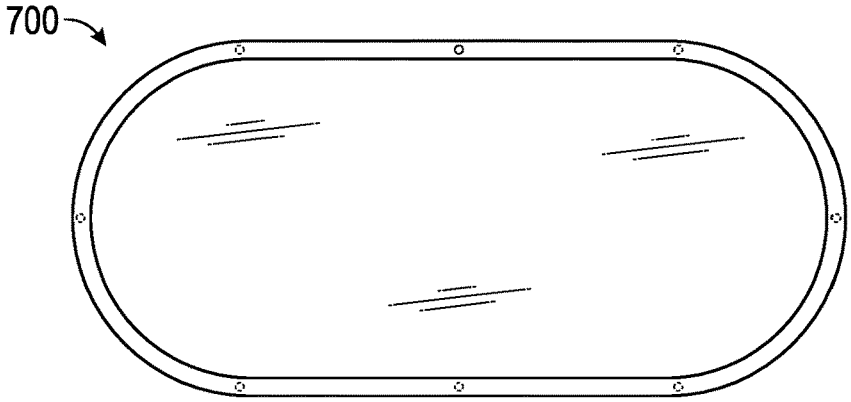
FIGS. 14A to 14C are top, side, and end views, respectively, of the oval tray of FIG. 13, in accordance with embodiments.
Figure 14B:
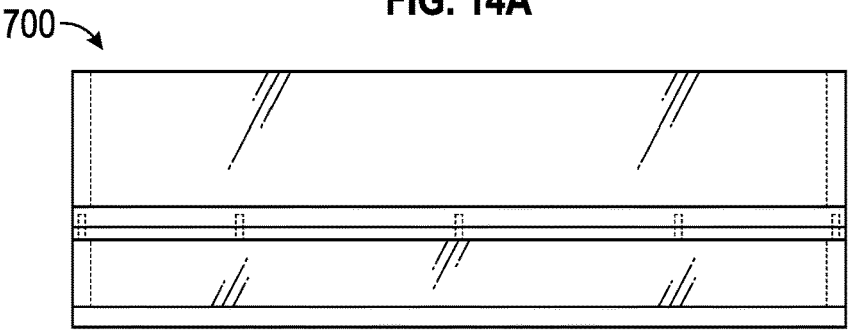
Figure 14C:
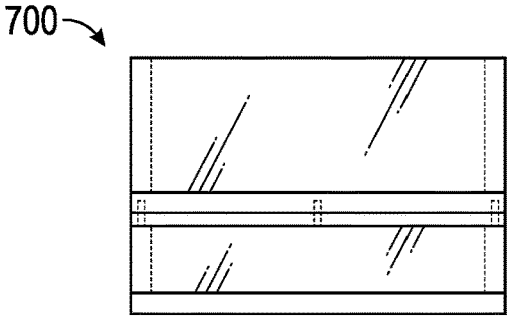

According to various embodiments, the height, width, and/or length dimensions of the container 100 can be configured according to any number of sizes or dimensions, and/or any shape. With respect to the latter, in the illustrated embodiment, the container 100 is configured as a square-shaped tray. In other embodiments, the container can be configured to form a different shaped tray or otherwise have a different shape. For example, FIG. 5 illustrates a container 300 configured to have a rectangular shape with no handles (e.g., like container 200 of FIG. 3), while FIG. 6 illustrates a container 400 configured to have a rectangular shape with handles similar to the handles 115 of container 100. And FIG. 9 illustrates a container 500 configured to have an elongated rectangular shape. As another example, FIG. 11 illustrates a container 600 configured to have a circular shape, while FIG. 13 illustrates a container 700 configured to have an oval shape. In still other embodiments, the container may be configured to have other rounded or oblong shapes, or any other desired shape.

Each of the containers 200, 300, 400, 500, 600, and 700 may be substantially similar to the container 100, but for the shape and size and/or the presence of handles. For example, each of these containers comprises a storage compartment and an insert compartment that are substantially similarly shaped and removably coupled to each other using a plurality of magnets or other suitable attachment mechanism, the insert compartment being configured to house a decorative insert for display through a bottom display surface of the storage compartment, as described herein. Thus, for the sake of brevity further description of these other containers is not provided herein.

Referring now to FIGS. 15 and 16A to 16C, shown is an exemplary storage container 800 with changeable decorative insert capability similar to that of the containers described above, in accordance with embodiments. Unlike the above containers, however, the storage container 800 comprises a main storage compartment 802 and an insert compartment 804 detachably coupled above the storage compartment 802, so that a decorative insert 806 housed in the insert compartment 804 is displayed on top of the container 800, instead of underneath the storage compartment, as in container 100 of FIG. 1. For example, the insert compartment 804 may be configured as a lid for the storage compartment 802. For the sake of brevity, the components of the container 800 that are substantially similar to corresponding components of the container 100 will not be described in great detail in the following paragraphs as appropriate descriptions have already been provided above.

According to embodiments, the insert compartment 804 comprises a display surface 808 made of a substantially clear material (e.g., transparent acrylic) configured to visibly display the decorative insert 806 through the display surface 808, similar to the display surface 110 of the container 100, but positioned at a top of the container 800, as shown in FIG. 15. The insert compartment 804 further comprises one or more first sidewalls 810 that extend down from the display surface 808 and define an open bottom 812 opposite the display surface 808. The one or more first sidewalls 810 may be made of a substantially clear material like the display surface 808 to facilitate display of the decorative insert 806.

The open bottom 812 can be configured to receive the decorative insert 806 with a decorative side of the insert 806 facing upwards towards the display surface 808. A height of the one or more first sidewalls 810 can be configured based on a thickness of the decorative insert 806 so that the decorative insert 806 can be housed within the insert compartment 804 in a snug but not too compressed manner (e.g., as described herein). In order to secure the decorative insert 806 therein, the insert compartment 804 also comprises a bottom panel 814 and at least one attachment mechanism 816 configured to detachably couple the bottom panel 814 to the one or more first sidewalls 810 opposite the display surface 808. Like the at least one attachment mechanism 122 of the container 100, the at least one attachment mechanism 816 may comprise a first plurality of magnets 816*a* disposed in the one or more first sidewalls 810 around the open bottom 812, and a second plurality of magnets 816*b* correspondingly disposed in the bottom panel 814 so that the bottom panel 814 magnetically attaches to the one or more first sidewalls 810.

The storage compartment 802 comprises a base 818 and one or more second sidewalls 820 that extend up from the base 818 and define an open top 822 opposite the base 818. The storage compartment 802 may be made of a substantially clear material like the display surface 808 to facilitate display of the decorative insert 806. In embodiments, the storage compartment 802 may be configured as a box or other container for storing one or more items. For example, a height of one or more second sidewalls 820 can be at least twice the height of the one or more first sidewalls 810 to create a larger containment area within the storage compartment 802. Also, when the insert compartment 804 is fully assembled, e.g., the bottom panel 814 is coupled to the one or more first sidewalls 810, the insert compartment 804 can operate as a lid for the storage compartment 802, for example, to keep the stored items covered or secured.

In particular, the bottom panel 814 of the insert compartment 804 can be configured for removable attachment to the open top 822 of the storage compartment 802. In some embodiments, the bottom panel 814 may comprise a protruding portion 824 that extends down from the bottom panel 814 and is configured (e.g., sized and shaped) to seal the open top 822 when attached to the storage compartment 802. The protruding portion 824 may be disposed on the bottom surface of the bottom panel 814 opposite the top surface that contains the plurality of magnets 816*b*, as shown. In other embodiments, the bottom panel 814 may include a different mechanism for closing or sealing the open top 822 of the storage compartment 802 or otherwise attaching the bottom panel 814 to the one or more second sidewalls 820, such as, for example, removable adhesive, other friction-fit mechanism, magnetic attachment, or any other removable attachment mechanism.

In the illustrated embodiment, the container 800 is configured as an oval or oblong-shaped box and thus, the insert compartment 804 includes a single first sidewall 810 and the storage compartment 802 includes a single second sidewall 820. In other embodiments, the container 800 may have other shapes and/or sizes (e.g., circular, rectangular, hexagonal, etc.). As will be appreciated, in embodiments where the container 800 is configured as a rectangular or square shaped box or the like, the insert compartment 804 and the storage compartment 802 may each include a plurality of sidewalls, for example, as shown for the square-shaped container 100 of FIG. 1.

Referring now to FIGS. 17 and 18A to 18C, shown is another exemplary storage container 900 with changeable decorative insert capability similar to the containers described above, in accordance with embodiments. Unlike the above containers, however, the storage container 900 comprises a main storage compartment 902 and an insert compartment 904 that is detachably coupled to a front side of the storage compartment 902, so that a decorative insert 906 housed in the insert compartment 904 is displayed in front of the container 900, instead of underneath the storage compartment, as in container 100 of FIG. 1, or on top of the storage compartment, as in container 800 of FIG. 15. For example, the insert compartment 904 may be configured as a decorative front panel for the storage compartment 902. For the sake of brevity, the components of the container 900 that are substantially similar to corresponding components of the container 100 will not be described in great detail in the following paragraphs as appropriate descriptions have already been provided above.

Figure 18A:
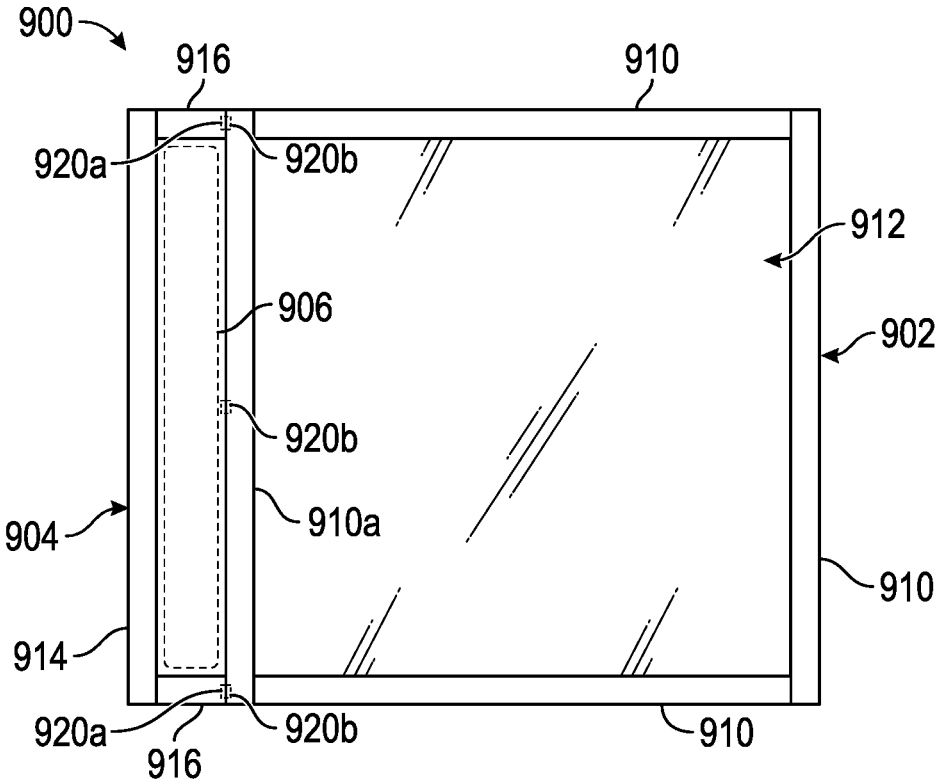
FIGS. 18A to 18C are top, side, and front views, respectively, of the square box of FIG. 17, in accordance with embodiments.

The storage compartment 902 comprises a base 908 and a plurality of first sidewalls 910 that extend up, or vertically, from the base 908 and define a top 912 opposite the base 908. The first sidewalls 910 comprise a front wall 910*a* that is detachably coupled to the insert compartment 904. In the illustrated embodiment, the storage compartment 902 is configured to form a cube, or a square-shaped box with four sidewalls 910, as best shown in FIG. 18A. In other embodiments, the storage compartment 902 may be configured as a rectangular-shaped box or a box with any other suitable shape. In the illustrated embodiment, the top 912 (also referred to herein as an "open top") is open. In other embodiments, the top 912 may be fully or partially closed, for example, using a movable cover or lid.

The insert compartment 904 comprises a display surface 914 and a plurality of second sidewalls 916 that extend out, or horizontally, from the display surface 914 and define an opening 918 opposite the display surface 914. For example, the insert compartment 904 may include four sidewalls 916, one on each of the four sides of the display surface 914. The opening 918 of the insert compartment 904 can be configured (e.g., sized and shaped) to receive the decorative insert 906 with a decorative side of the insert 906 facing sideways towards the display surface 914 and away from the front wall 910*a* of the storage compartment 902. The display surface 914 can be made of a substantially clear material (e.g., transparent acrylic) that is configured to visibly display the decorative insert 906 through the display surface 914. In some embodiments, the second sidewalls 916 may also be made of a substantially clear material like the display surface 914 to facilitate display of the decorative insert 906. In some embodiments, the storage compartment 902 may be made of a substantially clear material as well, like the display surface 914.

Figure 18B:
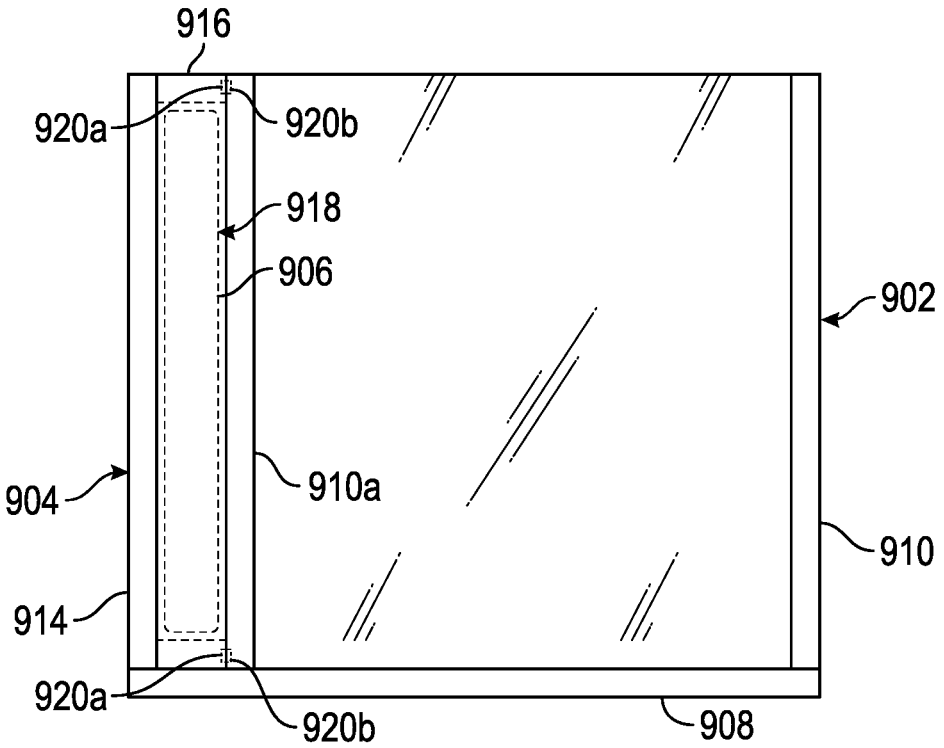
Figure 18C:
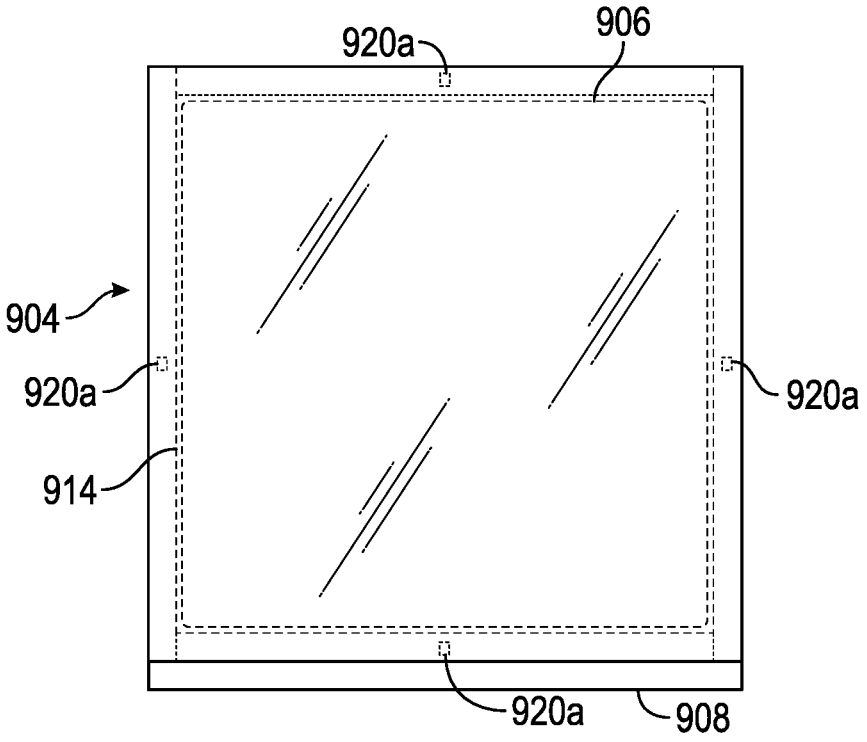

Each of the second sidewalls 916 has a length configured to house the decorative insert 906 within the insert compartment 904. For example, as shown in FIGS. 18A and 18B, the length of the second sidewalls 916 can be configured to position the display surface 914 a preset distance from the front wall 910*a* of the storage compartment 902, upon coupling the two compartments together. The preset distance can be determined based on a thickness of the decorative insert 906, so that the insert 906 fits snugly between the display surface 914 and the front wall 910*a* upon coupling.

The container 900 further comprises at least one attachment mechanism 920 configured to detachably couple the plurality of second sidewalls 916 of the insert compartment 904 to the front wall 910*a* of the storage compartment 902, so that the opening 918 is covered by the front wall 910*a*. Like the at least one attachment mechanism 122 of the container 100, the at least one attachment mechanism 920 may comprise a first plurality of magnets 920*a* disposed in the one or more second sidewalls 916 around the opening 918 of the insert compartment 904, and a second plurality of magnets 920*a* correspondingly disposed on the front wall 910*a* of the storage compartment 902, so that the front wall 910*a* magnetically attaches to the second sidewalls 916. In the illustrated embodiment, the front wall 910*a* includes four magnets 920*b* and the insert compartment 904 includes four magnets 920*a* correspondingly arranged on respective second sidewalls 916 so that each magnet 920*b* aligns with a respective magnet 920*a* when the two compartments 902 and 904 are coupled together.

Thus, an improved container for interchangeably displaying decorative inserts is provided herein. The container can include an insert compartment removably coupled to a storage compartment using one or more attachment mechanisms. The insert compartment can be configured to house a decorative insert against a display surface, and the storage compartment can be configured as a tray, dish, box, crate, or any other type of containment unit. In various embodiments, the attachment mechanism may comprise a plurality of magnets correspondingly disposed on the insert compartment and the storage compartment so that the insert compartment can be secured to the storage compartment but also removed from the storage compartment, as needed, to remove or replace the decorative insert.

It will be understood by those skilled in the art that various changes may be made and equivalents may be substituted without departing from the scope of the novel and non-obvious techniques disclosed in this application. Therefore, it is intended that the novel teachings of the present invention not be limited to the particular embodiment disclosed, but that they will include all embodiments falling within the scope of the appended claims.

What is claimed is:

1. A container, comprising:

a storage compartment comprising a display surface and one or more first sidewalls extending up from the display surface and defining an open top opposite the display surface; and an insert compartment comprising a base and one or more second sidewalls extending up from the base and defining an opening opposite the base; and at least one attachment mechanism configured to detachably couple the insert compartment to the display surface of the storage compartment, wherein the at least one attachment mechanism comprises a first plurality of magnets disposed on the display surface, and a second plurality of magnets correspondingly disposed in the one or more second sidewalls around the opening so that the insert compartment magnetically attaches to the storage compartment; and wherein a height of the one or more second sidewalls is configured to house a decorative insert within the insert compartment, and the display surface is made of a substantially clear material configured to visibly display the decorative insert through the display surface.

2. The container of claim 1, wherein the height of the one or more second sidewalls is configured to position the display surface a preset distance from the base of the insert compartment, the preset distance being determined based on a thickness of the decorative insert.

3. The container of claim 1, wherein the opening of the insert compartment is configured to receive the decorative insert with a decorative side of the insert facing upwards towards the display surface.

4. The container of claim 1, wherein at least one of the one or more first sidewalls comprises an aperture configured to operate as a handle.

5. The container of claim 1, wherein the display surface and the base are substantially flat surfaces disposed substantially parallel to each other.

6. The container of claim 1, wherein the one or more second sidewalls are configured to be flush with the one or more first sidewalls upon coupling the insert compartment to the storage compartment.

7. The container of claim 1, wherein a height of the one or more first sidewalls is configured to form a containment area in the storage compartment.

8. The container of claim 1, wherein each of the storage compartment and the insert compartment has a substantially similar square shape.

9. The container of claim 1, wherein each of the storage compartment and the insert compartment has a substantially similar rectangular shape.

10. The container of claim 1, wherein each of the storage compartment and the insert compartment has a substantially similar round shape.

11. The container of claim 1, wherein each of the storage compartment and the insert compartment has a substantially similar oval shape.

12. The container of claim 1, wherein a height of the one or more first sidewalls is greater than a height of the one or more second sidewalls.

13. The container of claim 1, wherein the one or more first sidewalls are also made of the substantially clear material, so that the decorative insert is visible through any side of the storage compartment.

14. The container of claim 1, wherein the substantially clear material is an acrylic material.

15. A container, comprising:

a storage compartment comprising a display surface and one or more first sidewalls extending up from the display surface and defining an open top opposite the display surface, wherein at least one of the one or more first sidewalls comprises an aperture configured to operate as a handle; and an insert compartment comprising a base and one or more second sidewalls extending up from the base and defining an opening opposite the base, and at least one attachment mechanism configured to detachably couple the insert compartment to the display surface of the storage compartment, wherein a height of the one or more second sidewalls is configured to house a decorative insert within the insert compartment, and the display surface is made of a substantially clear material configured to visibly display the decorative insert through the display surface.

16. The container of claim 15, wherein the height of the one or more second sidewalls is configured to position the display surface a preset distance from the base of the insert compartment, the preset distance being determined based on a thickness of the decorative insert.

17. The container of claim 15, wherein the display surface and the base are substantially flat surfaces disposed substantially parallel to each other.

18. The container of claim 15, wherein the one or more second sidewalls are configured to be flush with the one or more first sidewalls upon coupling the insert compartment to the storage compartment.

19. The container of claim 15, wherein a height of the one or more first sidewalls is greater than a height of the one or more second sidewalls.

20. The container of claim 15, wherein the one or more first sidewalls are also made of the substantially clear material, so that the decorative insert is visible through any side of the storage compartment.

* * * * *